United States Patent [19]

Murray et al.

[11] 4,038,897

[45] Aug. 2, 1977

[54] ELECTRONIC MUSIC SYSTEM AND STRINGED INSTRUMENT INPUT DEVICE THEREFOR

[75] Inventors: Jeffrey J. Murray, Ellington; Jeffrey L. Bachiochi, Rockville; Norman L. Milliard, Stafford, all of Conn.

[73] Assignee: Electronic Music Laboratories, Inc., Rockville, Conn.

[21] Appl. No.: 621,966

[22] Filed: Oct. 14, 1975

[51] Int. Cl.[2] ..... G10H 1/00; G10H 3/00; G10H 3/06

[52] U.S. Cl. ..... 84/1.16; 84/1.01; 84/1.17

[58] Field of Search ..... 84/1.01, 1.03, 1.16, 84/1.17, 1.24, DIG. 7, DIG. 8, DIG. 30

[56] References Cited

U.S. PATENT DOCUMENTS

| | | | |
|---|---|---|---|
| 3,116,357 | 12/1963 | Krebs | 84/DIG. 30 |
| 3,530,227 | 9/1970 | Wheeler et al. | 84/1.16 |
| 3,666,875 | 5/1972 | Ranzato | 84/1.16 |
| 3,828,110 | 8/1974 | Collin | 84/1.01 |
| 3,902,395 | 9/1975 | Avant | 84/DIG. 30 |

*Primary Examiner*—E. S. Jackmon

*Attorney, Agent, or Firm*—McCormick, Paulding & Huber

[57] ABSTRACT

An electronic music system includes a voltage controlled tone generator, or synthesizer, and an input device, in the form of a guitar or other fretted stringed instrument and associated electronic circuitry, for sequentially providing voltage signals, selected from a set of discretely different voltage levels each analogously related to a musical tone, for driving the tone generator. Each string-fret pair of the stringed instrument is assigned a given musical tone, preferably in accordance with normal tuning of the instrument, and means are provided for producing a corresponding voltage when a string-fret pair is closed by pressing the string against the fret. When two or more string-fret pairs are simultaneously closed, the output voltage corresponding to the highest frequency musical tone associated with the closed string-fret pairs is produced. In particular, different electrical voltages are applied to the instrument frets so as to apply such voltages to the strings when the strings are pressed into contact with the frets. A multiplexing system repetitively samples the string voltages, adds to each string voltage an offset voltage compensating for the musical intervals between the open strings, and processes the highest summed voltage for output to the tone generator.

13 Claims, 5 Drawing Figures

ELECTRONIC MUSIC SYSTEM AND STRINGED INSTRUMENT INPUT DEVICE THEREFOR

BACKGROUND OF THE INVENTION

This invention relates to electronic music producing systems having a voltage controlled tone generator or synthesizer, for sequentially producing electrical audio frequency signals, for driving a loud speaker or other electro-acoustical transducer, having fundamental frequencies controlled in accordance with the values of input voltage signals, and deals more particularly with a device for producing such input voltage signals which device is generally in the form of a guitar or other fretted stringed instrument.

Electronic music systems having voltage controlled tone generators or synthesizers are well known in the art. The tone generator of such a system usually includes a large number of manually adjustable controls for varying various tone characteristics, such as timbre, attack, decay, vibrato, tremolo, etc. to obtain different sounds or effects. However, the basic sequence of the tones and their timing is usually controlled manually through a generally conventional keyboard played in a generally conventional manner. Thus, persons performing on presently known synthesizer systems should be relatively skilled keyboard instrument players, and such systems are of limited usefulness to musicians skilled primarily in the playing of non-keyboard instruments.

The general object of this invention is, therefore, to provide a music system of the type having a voltage controlled tone generator, or synthesizer, but wherein the input signals to the tone generator are produced by a guitar or other fretted stringed instrument thereby allowing the system to be played by guitarists or others more skilled in or preferring to use a guitar or similar stringed instrument as the input device rather than a keyboard.

Synthesizers are also now often used as instruments played by performing groups of artists. In a performance it is often desirable for a performer to switch from one instrument to another, and in keeping with this another advantage of the present invention is that the guitar or the like used to provide the voltage input signals for the synthesizer may also be played in its conventional fashion, thereby allowing the performer to switch back and forth between a synthesizer effect and a guitar effect without physicaly changing instruments.

Other objects and advantages of this invention will be apparent from the drawings and from the description forming a part hereof.

SUMMARY OF THE INVENTION

This invention concerns an electron music system having a voltage controlled tone generator and resides especially in a stringed instrument and associated electronic circuitry for sequentially providing input voltage signals for the tone generator. The stringed instrument has at least one string and a plurality of frets spaced from one another along the length of the string with each string-fret pair representing an assigned musical tone. The associated electronic circuitry is responsive to a string being pressed into contact with any one of the frets for supplying to the tone generator a voltage having a value analogously related to the frequency of the musical tone represented by the closed string-fret pair.

More particularly, the invention resides in the voltage signals being produced by applying a different voltage level to each fret of the stringed instrument so that when a string is pressed against a fret, the fret voltage is applied to the string from which it is sensed to identify the contacting or closed string-fret pair. When the instrument has more than one string, the string voltages are sampled repetitively by a multiplexer and offset voltages are added by an adding circuit to the string voltages to account for the musical intervals between the open strings. A peak detector passes on only the highest voltage produced by the adding circuit during one sampling cycle and, therefore, avoids ambiguity caused by two or more strings being simultaneously pressed into contact with frets.

BRIEF DESCRIPTION OF THE DRAWINGS

FIG. 4 is a view showing the manner in which FIGS. 2*a* and 2*b* are to be placed side by side to form FIG. 2.

DETAILED DESCRIPTION OF THE PREFERRED EMBODIMENTS

Figure 1:
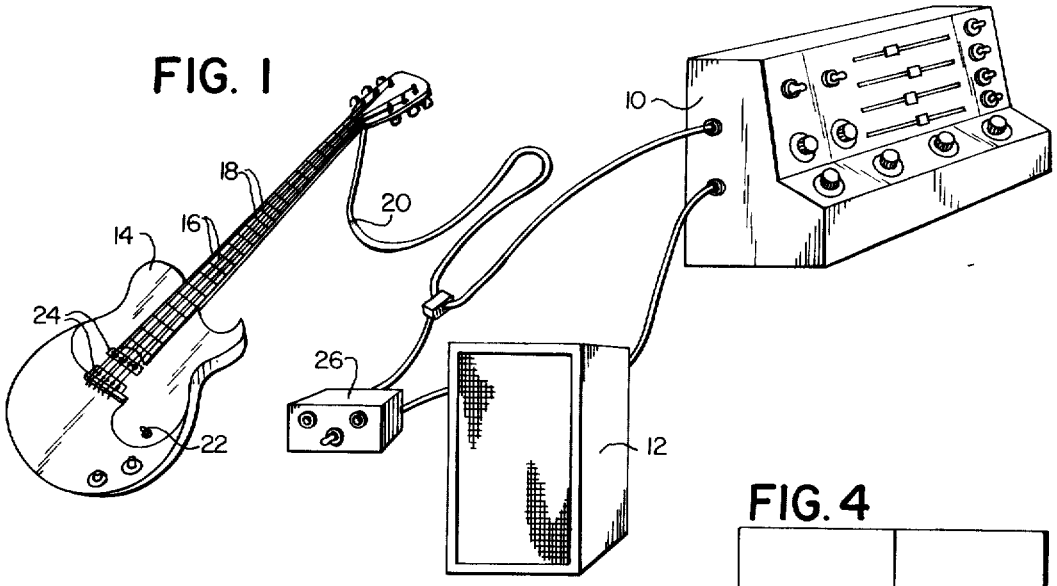
FIG. 1 is a perspective view showing generally a music producing system embodying this invention.
Figure 4:
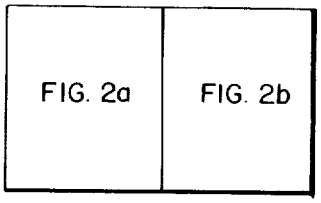

Referring first to FIG. 1, this figure shows in general a music producing system embodying the present invention. The system includes a voltage controlled tone generator or synthesizer 10 which may be of any one of various different well known constructions. In response to sequentially appearing input voltage signals it produces audio frequency output signals having basic or fundamental frequencies analogously related to the levels of the input signals. A loud speaker 12 or other electro-acoustical transducer converts the audio frequency output signals into audible sounds. By various different manually adjustable control elements forming part of the synthesizer 10 it may be adjusted, as well known, to widely vary the characteristics of the output signals to produce sounds of different musical effect.

In accordance with this invention, the means for producing the input voltage signals for the synthesizer 10 includes a device in the form of a fretted stringed musical instrument. Within the broader aspects of this invention, the instrument may include only a single string, but preferably the instrument is a multiple stringed one of conventional size, shape and construction and in FIG. 1 is shown to be a guitar 14. The illustrated guitar 14 has six strings 16, 16 and a fret board with twenty frets 18, 18. Each string-fret pair has an assigned musical tone and when a given string-fret pair is closed, a voltage analogously related to the musical tone associated with such string-fret pair is transmitted, as by an output cable 20, to the synthesizer 10 as an input signal thereto. The electrical circuit for producing such voltage signals in response to the string-fret pair closings may consist basically of integrated circuit components mounted on a circuit board or otherwise packaged as a relatively small unit, and in FIG. 1 it is assumed that it is housed within the body of the guitar 14, although it could be, if desired, included in the housing of the synthesizer 10 or in its own separate housing.

The guitar 14 of FIG. 1 is of a generally conventional electric guitar construction and preferably it includes a means, such as a switch 22 for allowing it to be switched between "synthesizer" and "guitar" modes wherein it is operable respectively either as a synthesizer input device or as an ordinary electric guitar. For operation in the "guitar" mode, the guitar 14 includes two conventional magnetic pickups 24, 24. When the switch 22 is switched to the guitar mode the outputs of the pickups 24, 24 are supplied to a conventional amplifier 26 for driving the loudspeaker 12. Of course, it is not necessary that the guitar or similar input device by capable of playing in both modes, and if desired it may be designed for operation in the synthesizer mode only in which case various features, such as tuning of the strings, necessary only to the guitar mode of operation may be omitted.

Figure 2A:
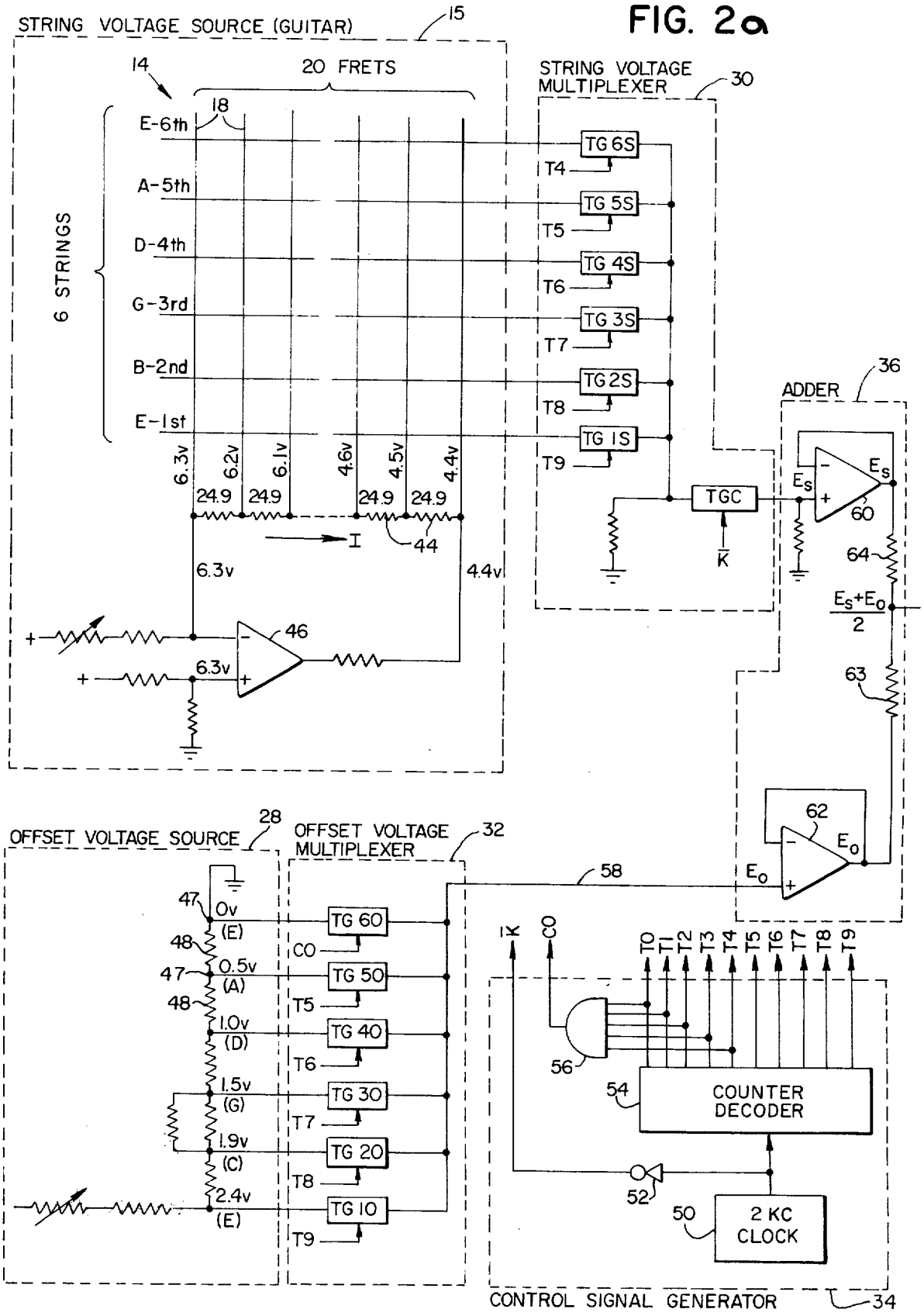
FIG. 2*a* and FIG. 2*b* when placed together as shown in FIG. 4 produce a single figure, referred to hereinafter as FIG. 2, showing the electrical circuit diagram of the music system of FIG. 1.
Figure 2B:
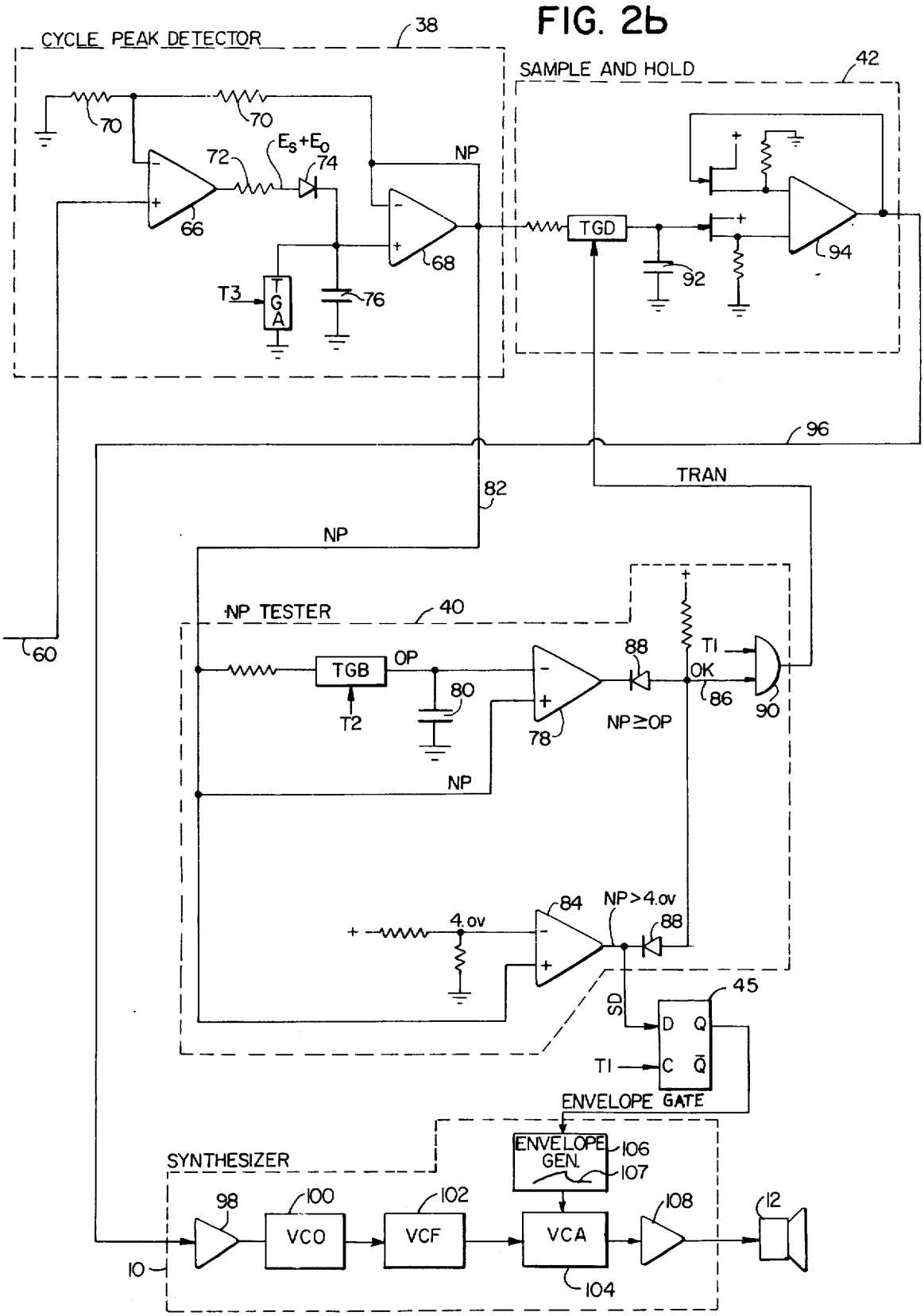

Turning now to FIG. 2, this figure shows in more detail the construction of the system of FIG. 1 embodying this invention. Referring to this figure, the basic blocks of the system, in addition to the synthesizer 10 and loud speaker 12, include a string voltage source 15, comprised of the guitar 14, and an associated electrical energizing circuit for applying different discrete voltages to the strings 16, 16 in dependence on which ones of the string-fret pairs are closed. Also included in the system is an offset voltage source 28, a string voltage multiplexer 30, an offset voltage multiplexer 32, a control signal generator 34, an adder 36, a cycle peak detector 38, a new peak (NP) tester 40, a sample and hold circuit 42 and a D type flip-flop 44.

The string voltage souce 15 includes the six guitar strings 16, 16 which are preferably assigned the usual open string guitar tones as shown. The twenty frets 18, 18 are also spaced along the fret board 20 with the lowest tone fret being shown at the right in FIG. 3 and the highest tone fret at the left. A semi-tone interval is assigned between each open string and the first or lowest tone fret, and a semi-tone interval is also assigned between each fret and its next adjacent higher tone fret. Different discrete voltages are applied to the different frets with the voltage levels increasing progressively and uniformly in going from the lowest tone fret to the highest tone fret.

The means for applying the different voltages to the frets 18, 18 consists of nineteen resistors 44, 44 connected in series with one another between the frets 18, 18. The resistors 44, 44 are of equal value and in the illustrated case are each shown for example to have a resistance of 24.9 ohms. The resistors 44, 44 are energized by an operational amplifier 46 connected as shown so as to provide a constant voltage, for example 6.3 volts, on its inverting input terminal and a constant current I, for example approximately 4.02 ma, through the series connected resistors 44, 44. Thus, in the illustrated case, when the strings are all in their open or unstopped conditions, a voltage of 6.3 volts appears on the highest tone fret 18 and a voltage drop of 100 mv exists between adjacent frets so that the voltage applied to the other frets are as shown with the lowest tone fret having a voltage of 4.4 volts.

The frets 18, 18 are of metal or other electrically conductive material and the strings 16, 16 are likewise of metal or other electrically conductive material. Therefore, when a string 16 is pressed against a fret 18, the fret voltage will appear on the string. Normally, when a string is pressed against a fret, the finger pressing the string is located some distance behind the fret so that the string is not only pressed against the desired fret but also against the next adjacent lower toned fret. The string, therefore, provides a short circuit between the two contacted frets, shunts the resistor 44 between those frets and changes the total value of the resistance appearing between the highest tone fret and the lowest tone fret. However, due to the constant current I provided by the amplifier 46 and the fact that the amplifier 46 operates to maintain 6.3 volts on the highest tone fret 18, the voltage appearing on the fret associated with the highest toned closed string-fret pair will remain unchanged from the value appearing on such fret when the string is in an open condition. That is, for example, if any one of the six strings is pressed against the third highest valued fret, which has a voltage of 6.1 volts thereon when all of the strings are in their open conditions, the value of 6.1 volts will remain on that fret and on the string pressed there against even though the string may also at the same time be pressed against any one or more other lower valued fret or frets. Thus, when a string is pressed simultaneously against any two frets, the voltage applied to the string is the voltage of the higher valued fret.

The offset voltage source 28 provides a set of six different voltages, appearing on six voltage taps 47, 47, assigned respectively to the six strings of the guitar to compensate for the musical intervals appearing between the open strings. In particular, the source 28 consists of a voltage divider comprised of a set of resistors 48, 48 connected between the taps 47, 47 and to a suitable source of voltage, as shown, and having appropriate resistance values to provide the six voltage values shown. These six voltages are: 2.4 volts associated with the high E or first string, 1.9 volts associated with the B string, 1.5 volts associated with the G string, 1.1 volts associated with the D strings, 0.5 volts associated with the A string, and 0 volts associated with the low E or sixth string. Therefore, from FIG. 2, it will be obvious that the voltage drop between the offset voltages associated with the different strings is equal to 100 mv. for each semi-tone interval between the open strings. For example, the difference in the offset voltages associated with the high E and B strings is 500 mv. in correspondence with the five semi-tone intervals between such two strings, and the difference in the offset voltages associated with the B and G strings is 400 mv. in correspondence with the four semi-tone intervals between those two strings.

Figure 3:
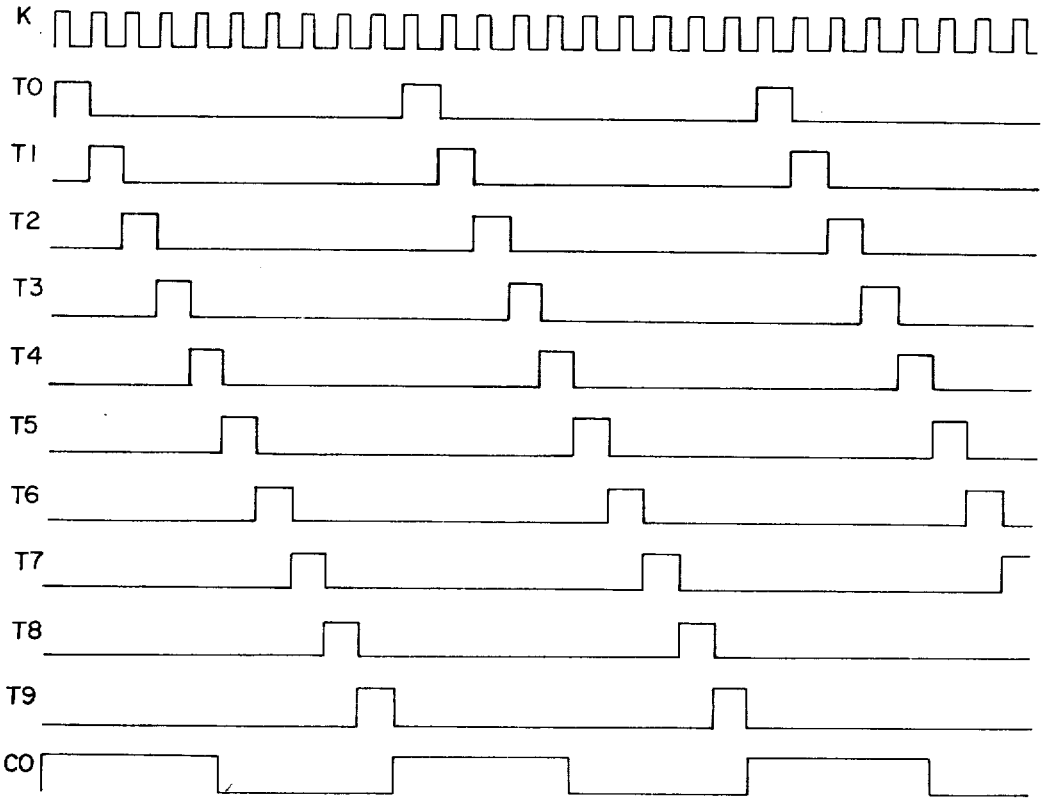
FIG. 3 is a view showing the control signals produced by the control signal generator of FIG. 2.

The system of FIG. 2 operates to cyclicly sample the voltages appearing on the six strings of the guitar 14, to add to such voltages the related offset voltages, thereby producing voltages representing actual tones, and to process the highest tone voltage produced during a sampling cycle for transmission to the synthesizer 10. The cyclic sampling of the string voltages and the corresponding selection of the offset voltages is effected by the string voltage multiplexer 30 and the offset voltage multiplexer 32 operated in synchronism with one another by the control signal generator 34. Referring to FIGS. 2 and 3, the control signal generator 34 includes a 2 kilocycle clock 50 producing the clock signal K. An inverter 52 also produces the inverted signal $\overline{K}$. The clock signal K is counted by a counter-decoder 54 to produce ten sequentially and cyclicly appearing control signal T0 to T9. An OR gate 56 connected to the T0 to T4 outputs of the counter-decoder 54 also produces the output signal CO.

The string voltage multiplexer 30 has six transfer gates or switches TG1S to TG6S, each of which may, for example, be a CMOS device. Each of these transfer gates has its input connected to a respective one of the six strings 16, 16 and its output connected to the input of another transfer gate TGC controlled by $\overline{K}$. The transfer gates TG1S to TG6S are controlled respectively by the control signals T9 to T4. Each transfer gate is turned on or to a conducting state during the appearance of its associated control signal and is at other times turned OFF or to a non-conducting state.

The offset voltage multiplexer 32 also consists of six transfer gates TG10 to TG60 each of which may also, for example, be a CMOS device. The input of each of these gates is connected to a respective one of the offset voltage taps 47, 47 of the offset voltage source 28 and its output is connected to an output line 58. The transfer gates TG10 to TG50 are controlled respectively by the control signals T9 to T5 and the transfer gate TG60 is controlled by the control signal CO.

The adder 36 includes two operational amplifiers 60 and 62 having their output terminals connected as shown through two equal valued resistors 64, 64 to an output line 60 so as to produce on the line 60 an output voltage related to the sum of the input string and offset voltages Es and Eo supplied respectively by the gate TGC and the line 58. More particularly the adder operates with an effective gain of one-half to produce on the line 60 a voltage equal to $Es + Eo/2$.

The cycle peak detector 38 operates to first amplify by a gain of two the voltage appearing on the line 60, to compensate for the one-half gain of the adder 36 and to thereby produce a restored voltage equal to $Es + Eo$, and to detect and temporarily save the highest such restored voltage obtained during a sampling cycle. The detector 38 includes an input operational amplifier 66 and an output operational amplifier 68. The output amplifier 68 is connected as a voltage follower. The input amplifier 66 has its non-inverting terminal connected as shown to the node between two equal resistors 70, 70 connected in series with one another between the output of the amplifier 68 and ground so as to give the input amplifier 66 a gain of two. The output of the input amplifier 66 is connected through a resistor 72 and diode 74 to a peak storing capacitor 76 and to the non-inverting terminal of the output amplifier 68. The peak storing capacitor 76 is shunted by a transfer gate TGA controlled by control signal T3 so that during the appearance of T3 the capacitor 76 is discharged to condition it for a new sampling cycle. During a sampling cycle, the highest restored voltage ($Es + Eo$) produced by the amplifier 66 during the cycle is stored on the peak storage capacitor 76, and it is thereafter referred to as the new peak voltage or NP.

The NP signal produced by the cycle peak detector is transmitted to the sample and hold circuit 42 and is transmitted from the sample and hold circuit to the synthesizer 10 for use as an input signal to the synthesizer 10 provided certain conditions are met as determined by the NP tester circuit 40. The NP tester 40 tests the Np signal for two conditions. The first condition tested is whether NP is greater than or equal to the immediately preceding NP signal, referred to as the old peak voltage or OP. As previously mentioned, when pressing a string into contact with a fret, the string is usually not only pressed into contact with the desired fret but also with the next adjacent lower toned fret. When releasing the string, it may then first break contact with either one of the two involved frets. Should the string first break contact with the desired higher tone fret and later break contact with the lower tone fret, the result could be the production and sampling of voltage relating to the lower tone fret and the unwanted production of a corresponding output signal and tone from the synthesizer 10 and loud speaker 12. The NP tester 40 prevents this from happening by requiring that NP be greater than or equal to OP before authorizing transmission of NP to the synthesizer.

The parts of the NP tester 40 used for testing whether NP is greater than or equal to OP include a comparing operational amplifier 78, an OP storage capacitor 80, and a transfer gate TGB controlled by the control signal T2 and having as an input the NP signal appearing on line 82. The storage capacitor 80 stores OP and applies it to the inverting terminal of the amplifier 78. The line 82 is directly connected to the non-inverting terminal of the amplifier 78 so as to supply NP to that terminal. The amplifier 78, therefore, operates to compare NP with OP and produces an output signal only when NP is greater than or equal to OP.

The second condition tested by NP tester 40 is whether NP is greater than the highest valued offset voltage provided by the offset voltage source 28. The reason for this test is that when all of the strings of the guitar are open, the system samples only zero voltages on all of the strings and will produce during each sampling cycle an NP signal equal to the highest offset voltage, of 2.4 volts. This voltage does not represent a desired tone and, therefore, should not be transmitted to the synthesizer.

The parts of the NP tester 40 used to test whether NP is greater than the highest offset voltage consists of a comparing operational amplifier 84 having NP supplied to its non-inverting terminal and a reference voltage supplied to its non-inverting terminal which reference voltage is greater than the highest offset voltage and less than the lowest fret voltage, the reference voltage in the illustrated case being taken to be 4.0 volts. Thus, it will be understood that when a string is pressed against a fret NP will be greater than the 4.0 volt reference voltage to produce a high output from the amplifier 84. Oppositely, when no string is pressed against a fret NP will be equal to the highest offset voltage of 2.4 volts, which is less than the 4.0 volt reference, to cause the output from the amplifier 84 to be low.

The outputs of the two test amplifiers 78 and 84 are connected to one another and to an output line 86 by two diodes 88, 88, as shown, to provide an AND gate circuit whereby a high or OK signal appears on the output line 86 only when the outputs from the two amplifiers 78 and 84 are high, thereby indicating that both conditions tested by the NP tester are satisfied. The OK signal appearing on the output line 86 is in turn transmitted through an AND gate 90, when enabled by control signal T1, to the sample and hold circuit 42.

Before leaving the NP tester 40, it should also be noted that NP has a value greater than the highest offset voltage when at least one of the strings of the guitar is pressed against a fret. Therefore, the output of the amplifier 84 is an indication of whether or not a string is pressed into contact with a fret. When the output of the amplifier 84 is high it constitutes a string down or SD signal which is transmitted to the flip-flop 45 to indicate the string down condition.

The sample and hold circuit 42 includes a memory or holding capacitor 92 to which NP is transferred from the cycle peak detector 38 through a transfer gate TGD controlled by the illustrated TRAN signal provided by the AND gate 90. The voltage appearing on the storage capacitor 92 is in turn supplied by a voltage follower operational amplifier, preferably having dual FET input terminals as shown, to the line 96 for transmission to the synthesizer 10 as the input signal thereto.

As mentioned, the synthesizer 10 may be of any well known construction and basically is a tone generator for producing an output audio frequency signal having a fundamental frequency controlled in response to the voltage level of the input voltage signal. By way of illustration, the synthesizer 10 in FIG. 2 is shown in more detail to include an exponential amplifier 98 to which the input signal appearing on the line 96 is applied. The input signals appearing on the line 96 vary linearly with tone values as measured by musical intervals between the tones. That is, the input signal, for example, increases by 100 mv. for each semi-tone increase in musical tone value. The frequencies of the tones, however, vary exponentially with changes in tone values, and amplifier 98 amplifies the incoming voltage signal by a gain varying exponentially with input voltage to produce an output signal therefrom directly related in voltage level to the desired output tone frequency.

The signal provided by the exponential amplifier 98 is in turn supplied to a voltage controlled oscillator 100. The output of the voltage controlled oscillator 100 is a signal having a basic or fundamental frequency directly related to the value of the input voltage, but by manually adjustable controls in the synthesizer the signal may be selectively modified somewhat frequencywise to achieve various musical effects as, for example, by cyclicly varying the frequency about the fundamental frequency to provide a vibrato effect.

The output from the voltage controlled oscillator 100 is supplied to a voltage controlled filter 102 which in response to settings of various manually adjustable controls in the synthesizer conditions the signal input thereto to provide an output signal having a selected overtone content to control the timbre of the resultant sound. The output of the voltage controlled filter 102 is in turn supplied to a voltage controlled amplifier 104 controlled by an amplitude envelope generator 106. Each time the envelope generator is triggered on it produces a voltage waveform, such as indicated at 107, the shape of which is determined by the settings of various manually adjustable controls in the synthesizer, which is supplied to the amplifier 104 to control its gain and to thereby establish the attack and decay characteristics of each note played by the system.

The envelope generator 106 is controlled by the flip-flop 45. When a SD signal is supplied from the amplifier 84 such signal is transferred to the Q terminal of the flip-flop and transmitted to the envelope generator 106 as an ENVELOPE GATE signal, but such transfer does not occur until the flip-flop is clocked by T1 at which time it is known that the sample and hold circuit 42 contains a valid tone identifying signal. For so long as the SD signal thereafter persists, the flip-flop 45 continues to transmit the ENVELOPE GATE signal to the envelope generator 106 so that no new envelope can be initiated by the envelope generator 106 until all of the strings are released and a new SD signal produced by thereafter again pressing a string into contact with a fret. The amplifier 108 is a power amplifier for amplifying the output of the voltage controlled amplifier 106 and transferring it to the loud speaker 12.

Having now described the construction of the system of this invention as illustrated in FIG. 2, its operation may be summarized as follows. For the purpose of this discussion, assume that following all of the strings 16, 16 being open a single string is presed into contact with one of the frets. More particularly, assume that the B string is pushed into contact with the first or lowest valued fret to call for the production of a tone having the musical tonality of C.

The two kilocycle clock 50 drives the counter-decoder 54 to sequentially produce the control signals T0 to T9. At T3, transfer gate TGA is opened to discharge the peak detector storage capacitor 76. The control signals T4 to T9 then sequentially open the string voltage transfer gates TG1S to TS6S and the offset voltage transfer gates TG10 to TG60 to sequentially simultaneously sample the string voltages and the offset voltages, the sampling actually occurring when transfer gate TGC is opened during the $\overline{K}$ phase of each control signal. That is, at T4, the low E or sixth string voltage is sampled. It is zero and it is added to the also sampled offset voltage of zero volts to produce an input voltage of zero volts to the cycle peak detector 38 in turn producing no change to the condition of the capacitor 76. At T5, the A string voltage of zero volts is sampled. This zero voltage is added to the also sampled offset voltage of 0.5 volts to produce an input voltage to the peak detector of 0.25 volts and a voltage of 0.5 volts at the output of the amplifier 66. Since this is greater than the zero voltage thus far stored in the capacitor 76, the capacitor is accordingly charged to 0.5 volts. At T6, the D string voltage of zero volts is sampled and added to the also simultaneously sampled offset voltage of 1.0 volts to cause the output of the amplifier 66 to 1.0 volts, this is greater than the 0.5 volts previously stored in the capacitor 66 and therefore the capacitor is charged to a new level of 1.0 volts. At T7, the G string zero voltage is sampled and added to the also simultaneously sampled offset voltage of 1.5 volts to cause the output of the peak detector amplifier 66 to be 1.5 volts to which the capacitor 76 is in turn charged. At T8, the B string is sampled. Due to the pressing of this string into contact with the first fret its voltage is now 4.4 volts, and this voltage is added to the also simultaneously sampled 1.9 offset voltage to produce a voltage of 6.3 volts at the output of the amplifier 66, to which voltage the capacitor 76 becomes charged. At T9, the high E or first string voltage is sampled. This voltage, which is now zero is added to the also simultaneously sampled offset voltage of 2.4 volts to produce a voltage of 2.4 volts at the output of the peak detector amplifier 66. Since this voltage is less than the 3.15 volts already stored in the capacitor 76, no change in the charge on the capacitor 76 is made. Therefore, at the end of T9 NP, corresponding to the charge on the capacitor 76, has a value of 6.3 volts.

The control signal T0 is not used and therefore, following T9, when T0 occurs nothing happens.

At T1, the AND gate 90 is enabled. An OK signal is also supplied to the AND gate 90 at this time since both conditions tested by the NP tester 40 are satisfied. That is, NP is greater than OP and NP is also greater than the reference 4.0 volts. Thus, an output TRAN signal is produced by the AND gate 90 and is transmitted to the transfer gate TGD of the sample and hold circuit 42 to open the transfer gate TGD, during the occurrence of T1, and to thereby set the charge on the sample and hold capacitor 92 to the now 6.3 volt value of NP. Also at T1, the flip-flop 45 is clocked to transfer the SD signal now appearing at its D input to its Q terminal and to thereby supply an ENVELOPE TRIGGER signal to the envelope generator 106 to cause the envelope generator 106 to initiate the production of a new voltage waveform controlling the voltage controlled amplifier 104, to in turn initiate a new note from the loud speaker 12. The fundamental frequency of this note is controlled by the 6.3 volt voltage signal now appearing on the line 96. The operating characteristics of the synthesizer are such that this 6.3 volt input signal is analogous to the musical tone C and the synthesizer accordingly operates so that the tone produced is of such tonality.

At T2, the transfer gate TGB of the NP tester 40 is opened to update te storage capacitor 80 with NP, NP therefore becoming OP for the next sampling cycle. At T3, the peak detector capacitor 76 is again zeroed by opening of the transfer gate TGA and a new sampling cycle begins.

We claim:

1. An electronic music system comprising a voltage controlled tone generator, a stringed instrument having at least one string and a plurality of frets spaced from one another along the length of said string with each string-fret pair representing an assigned musical tone, and means responsive to said string being pressed into contact with any one of said frets for producing and supplying to said voltage controlled tone generator, as the driving input signal for said tone generator, a voltage signal having a voltage value analogously related to the frequency of the musical tone assigned to the contacting string-fret pair, said voltage controlled tone generator including means for producing an intermediate signal having a frequency related to said input voltage signal, an amplifier having a voltage controlled gain for varying the amplitude of said intermediate signal, an envelope generator for providing a voltage waveform controlling the gain of said amplifier, and means for turning said envelope generator on to initiate the production of a new voltage waveform therefrom in response to said at least one string being brought into contact with any one of said frets.

2. An electronic music system comprising a voltage controlled tone generator, a stringed instrument having a plurality of spaced parallel strings located over a fret board having a plurality of frets extending transversely of said strings and spaced one from another along the length of said fret board with each string-fret pair representing an assigned musical tone, and means responsive of any one of said strings being pressed into contact with any one of said frets for producing and supplying to said voltage controlled tone generator, as the driving input for said tone generator, a voltage signal having a voltage value analogously related to the frequency of the musical tone represented by the contacting string-fret pair.

3. A music system as defined in claim 2 further characterized by said voltage controlled tone generator including means for producing an intermediate signal having a frequency related to said input voltage signal, an amplifier having a voltage controlled gain for varying the amplitude of said intermediate signal, an envelope generator for producing a voltage waveform controlling the gain of said amplifier, and means for turning said envelope generator on to initiate the production of a new voltage waveform therefrom in response to any one of said strings being brought into contact with any one of said frets.

4. A music system as defined in claim 3 further characterized by means for inhibiting the production of another voltage waveform from said envelope generator until after all of said strings are first out of contact with any of said frets.

5. An electronic music system comprising a voltage controlled tone generator, a stringed instrument having a plurality of spaced parallel strings and a plurality of frets spaced from one another along the length of said strings and each extending transversely across all of said strings with each string-fret pair representing an assigned musical tone, and means responsive to any one or more of said strings being pressed into contact with any one or more of said frets for producing and supplying to said voltage controlled tone generator, as the driving input signal for said tone generator, a voltage signal having a voltage value analogously related to the frequency of the highest musical tone represented by the contacting string-fret pair or pairs.

6. An electronic music system as defined in claim 5 further characterized by said means for producing a voltage signal including means for applying a discrete voltage to each of said frets and which discrete voltage is different from that applied to other of said frets, an offset voltage source providing a plurality of offset voltages each assigned to a respective one of said strings and each of which offset voltages is different from the other of said offset voltages, and means responsive to any one of said strings being pressed into contact with any one of said frets for adding the voltage appearing on said one fret to the offset voltage assigned to said one string to produce a resultant voltage signal analogously related to the tone represented by the contacting string-fret pair.

7. An electronic music system comprising a voltage controlled tone generator, a stringed instrument having a plurality of sapced parallel electrically conductive strings and a plurality of electrically conductive frets spaced from one another along the length of said strings and each extending transversely across all of said strings with each string-fret pair representing an assigned musical tone, and means responsive to any one of strings being pressed into contact with any one of said frets for producing and supplying to said voltage controlled tone generator, as the driving input signal for said tone generator, a voltage signal having a voltage value analogously related to the frequency of the contacting string-fret pair, said means for producing a voltage signal including means for applying a discrete fret voltage to each of said frets and which discrete voltage is different from that applied to the other of said frets, an offset voltage source providing a plurality of offset voltages each assigned to a respective one of said strings and each of which offset voltages is different from the other of said offset voltages, a multiplexer means for sequentially and clclicly sampling the voltages appearing on said strings, means for adding each sampled string voltage to its corresponding offset voltage to produce a resultant voltage, means for detecting and temporarily storing the peak resultant voltage obtained during each sampling cycle, and means utilized said peak resultant voltage as said voltage signal supplied to said voltage controlled tone generator.

8. An electronic music system as defined in claim 7 further characterized by the highest one of said offset voltages provided by said offset voltage source being lower than the lowest one of said discrete fret voltages, and said means utilizing said peak resultant voltage including means for testing said peak resultant voltage and for inhibiting the transmission of said peak resultant voltage to said voltage controlled tone generator in the event said peak resultant voltage is less than said lowest one of said fret voltages.

9. An electronic music system as defined in claim 7 further characterized by said means utilizing said resultant peak voltage including means for comparing said new resultant peak voltage with the old resultant peak voltage obtained during the preceding sampling cycle and for inhibiting the transmission of said new resultant peak voltage to said voltage controlled tone generator in the event said new resultant peak voltage is less than said old resultant peak voltage.

10. An electronic music system as defined in claim 7 further characterized by said means for applying a discrete fret voltage to each of said frets comprising a plurality of resistors connected in series with one another with each of said resistors being electrically connected between a respective pair of said frts and means for providing a constant valued flow of current through said resistors.

11. An electronic music system as defied in claim 10 further characterized by said means for providing a constant value flow of current being arranged so that said current flows in the direction from the highest tone valued one of said frets to the lowest tone valued one of said frets whereby said highest tone valued fret has the highest discrete fret voltage applied to it.

12. A means for providing voltage signals for driving a voltage controlled tone generator in an electronic music producing system, said means comprising: a stringed musical instrument having a plurality of spaced parallel strings located over a fret board having a plurality of frets extending transversely of said strings and spaced from one another along the length of said fret board with each string-fret pair representing an assigned musical tone, and means responsive to any one of said strings being pressed into contact with any one of said frets for producing a voltage signal having a voltage value analogously related to the frequency of the musical tone assigned to the contacting string-fret pair.

13. A means for providing voltage signals for driving a voltage controlled tone generator in an electronic music producing system said means comprising: a stringed instrument having a plurality of spaced parallel electrically conductive strings located over a fret board having a plurality of electrically conductive frets extending transversely of said strings and spaced from one another along the length of said fret board, with each string-fret pair representing an assigned musical tone, means for applying an electric voltage to each of said frets with each of said frets having a voltage different from that applied to the other of said frets, an offset voltage source providing a plurality of offset voltages each assigned to a respective one of said strings with each of said offset voltages being different from the other of said offset voltages, and means responsive to any one of said strings being pressed into contact with any one of said frets for adding the voltage appearing on said one fret to the offset voltage assigned to said one string to produce an output signal, said fret voltage and said offset voltage being so selected that said output signal has a voltage value analogously related to the frequency of the musical tone represented by the contacting string-fret pair.

* * * * *